United States Patent [19]

Mulcahy

[11] Patent Number: 4,499,583

[45] Date of Patent: Feb. 12, 1985

[54] INDUCTION FURNACE

[75] Inventor: Joseph A. Mulcahy, Brooklin, Canada

[73] Assignee: J. Mulcahy Enterprises Incorporated, Whitby, Canada

[21] Appl. No.: 455,014

[22] Filed: Jan. 3, 1983

[30] Foreign Application Priority Data

Dec. 3, 1982 [CA] Canada ..... 417009

[51] Int. Cl.[3] ..... H05B 6/34

[52] U.S. Cl. ..... 373/161; 373/159; 373/160

[58] Field of Search ..... 373/138, 159–165, 373/151–153, 146

[56] References Cited

U.S. PATENT DOCUMENTS

| | | | |
|---|---|---|---|
| 1,068,558 | 7/1913 | Bally | 373/159 |
| 2,342,617 | 2/1944 | Tama et al. | 373/161 |
| 3,053,921 | 9/1962 | Tagliaferri | 373/160 |
| 3,330,900 | 7/1967 | Taylor et al. | 373/152 X |

FOREIGN PATENT DOCUMENTS

| | | | |
|---|---|---|---|
| 705229 | 1/1980 | U.S.S.R. | 373/163 |

*Primary Examiner*—A. D. Pellinen
*Assistant Examiner*—Gregory D. Thompson
*Attorney, Agent, or Firm*—Sim & McBurney

[57] ABSTRACT

A body of molten metal is simultaneously heated and rotated by the use of electromagnetic forces. In one embodiment, the melting of metals by induction heating is improved by using a circular spirally-wound electromagnetic core located between a central flow channel and six peripherally-located flow channels. Three-phase electrical current is applied to the core windings to form a rotating magnetic field which intercepts the metal in the peripherally-located flow channels. The magnetic field causes heating of the metal in the peripheral channels with negligible heating in the central channel, thereby causing flow of heated metal through the peripheral channels to the bath. The magnetic field also causes rotational motion of the body of molten metal, thereby improving mixing and minimizing surface turbulence. In another embodiment, the electromagnetic core is immersed in a body of molten metal to be surrounded thereby. Peripherally-located metal is heated and flows into the body of metal while axially-located metal is rotated.

9 Claims, 3 Drawing Figures

INDUCTION FURNACE

FIELD OF INVENTION

The present invention relates to the heating of molten metal bodies, such as in channel-type induction furnaces.

BACKGROUND TO THE INVENTION

Channel-type induction furnaces are used for preparing, preheating, mixing and storing molten metals which are subsequently delivered to recipients, such as ladles or foundry moulds. In channel-type induction furnaces a bath of molten metal is connected with at least two channels intersecting one another. Heating of the metal is effected by an electrical field associated with the channels.

Such induction furnaces are disadvantageous in that movement of metal in the channels, and hence heating of metal in the bath, is effected only by convection and electrodynamic forces during interaction of electrical current within the mass of molten metal with the magnetic field. The movement of metal is a result of a thermal action of the current flowing through the furnace channel.

One proposal to overcome this problem is contained in U.S. Pat. No. 3,502,781, wherein there is provided an additional magnetic conductor having windings for inducing a controlled magnetic field interacting with the current flowing through the point of intersection of the channels, so as to cause the molten metal to flow in a given direction at a controllable speed.

This prior art structure requires the use of three different magnetic cores, each fed by direct current voltage and is confined to heating in three channels. The energy density which can be brought to bear on the molten metal is limited in this structure, so that the size of the furnace is correspondingly limited.

The electrical fields which are applied in the prior art structure cause motion of the molten metal within the channels, typically downwardly in peripherally-located channels and upwardly in the centrally-located channel, and flow within the molten metal bath by vertical and radial motion within the bath. This procedure causes turbulence at the surface of the bath and hence continuous exposure of the bath to oxidation.

SUMMARY OF INVENTION

In accordance with the present invention, there is provided a procedure which overcomes the above-noted problems of the prior art. In accordance with the present invention, a single circular spiral-wound electro-magnet core is positioned surrounding an axially-extending centrally-located channel with the centre of curvature of the core coinciding with the axis of the central channel, and located between the central channel and multiples of two equally arcuately spaced axially-extending peripheral channels at least four in number. Multiple phase current is applied to the windings of the core, the number of phases of current corresponding to the number of the multiple of two peripheral channels used.

The application of the multiple phase current to the core windings produces a rotating magnetic field which induces an electric current in the metal in the peripheral channels while there is a zero summing effect of the phases of the field with respect to the metal in the central channel. This effect is similar to that obtained in an electric motor and accordingly attempts to cause the peripheral channels to rotate about the central channel. The fixed location of the channels prevents such rotation and instead the energy is dissipated as heat, causing the temperature of the metal in the peripheral channels to rise. The metal in the central channel remains unheated by the electrical field, as a result of the zero summing effect, so that metal flows under the influence of the temperature differential upwardly through the peripheral channels into the molten bath and downwardly through the central channel from the molten metal bath, thereby achieving heating of the metal of the bath.

The use of a single spiral-wound circular electromagnet core and multiple phase current avoids the necessity for direct-current fed separate cores for each peripheral channel with a third core to induce motion, as in the prior art, enables increased numbers of peripheral channels to be employed and enables an increased energy density, with consequently larger installation, to be achieved, in contrast to the prior art.

Another effect which is achieved by the present invention is that the same electric motor effect induces a rotational motion within the body of molten metal in the molten metal bath about the bath axis in addition to the axial and radial motion caused by the metal flow in the channels, and this decreases turbulence at the surface of the bath, in contrast to the prior art where such rotational motion is absent.

The present invention is not limited to a channel furnace arrangement of the above-described type, but also is applicable to the heating and stirring of a simple bath of molten metal. In this embodiment of the invention, the spiral-wound electro-magnetic is immersed in the molten bath so as to be surrounded by the molten metal, with its axis extending substantially vertically. The multiphase current then is passed through the core to form a rotating electromagnetic field. The induced current so produced in the peripherally-located portion of the body of the molten metal causes the bath to rotate. As a result of the viscosity of the molten metal, the speed of rotation cannot approach the speed of rotation of the magnetic field, so that the residual energy is dissipated as heat, causing heating of the peripherally-located metal. As a result of the zero summing effect in the centre of the core and the differential in temperature between the peripherally-located metal and the remainder of the body of metal there is motion of the molten metal upwardly into the body of metal and downwardly through the centre of the core, and hence mixing and heating of the body of metal of the bath. At the same time, the rotational effect which is achieved improved mixing and avoids turbulence.

The heating effect in this embodiment of the invention is not as great as it is in the case of the channel-type induction furnace, since complete rotational movement of metal in the channels is prevented in the latter case and hence all the induced electrical current is dissipated as heat, but is not in the former case, wherein some of the electrical current is dissipated in rotating the body of molten metal.

In accordance with the broadest aspect of the invention, therefore, there is provided a method of induction heating of a body of molten metal in a bath thereof which comprises simultaneously electromagnetically inducing (1) flow of unheated metal from the molten metal body and flow of heated molten metal to the molten metal body and (2) rotational motion of the metal in the bath.

The present invention also comprises the apparatus for effecting the method of the invention.

DESCRIPTION OF PREFERRED EMBODIMENT

Figure 1:
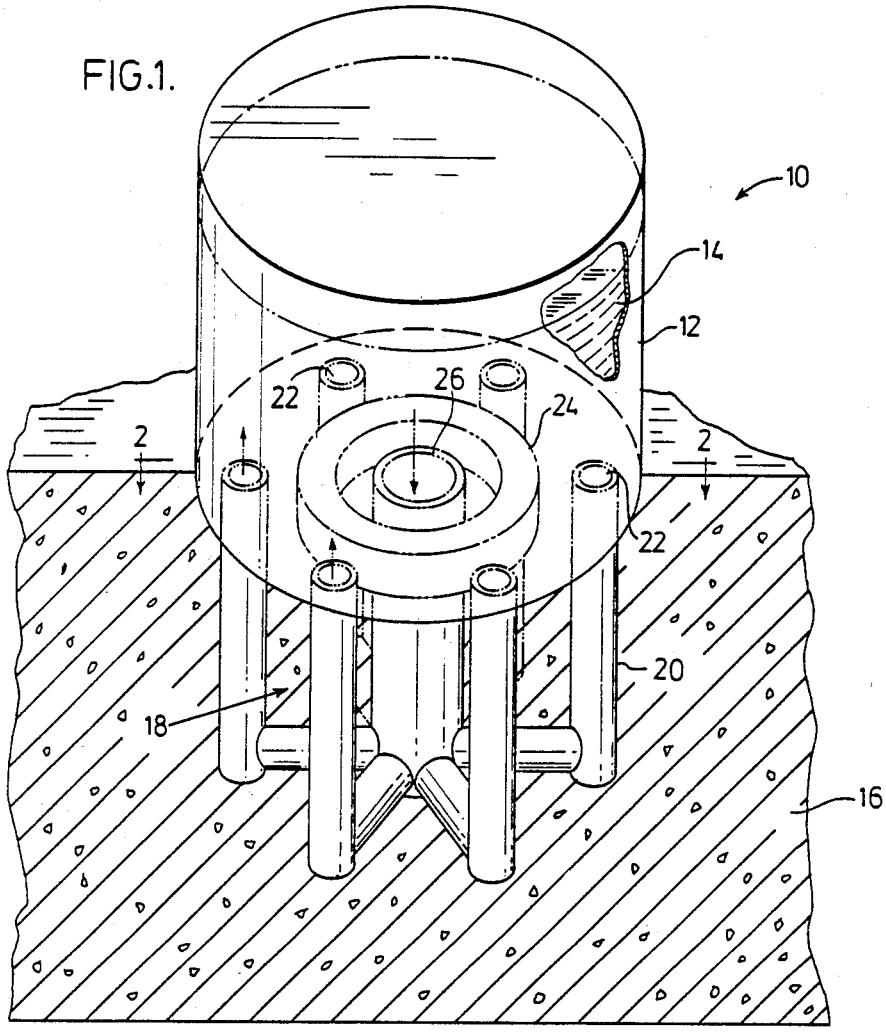
FIG. 1 is a perspective view with parts cut away for clarity, of an induction melting furnace provided in accordance with one embodiment of the invention.
Figure 2:
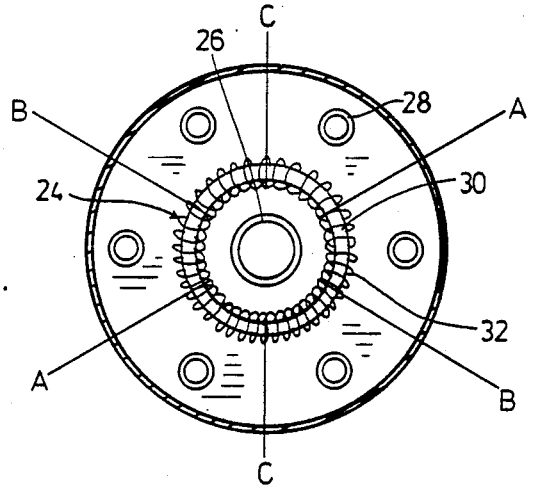
FIG. 2 is a sectional view taken on line 2—2 of FIG. 1.

Referring first to FIGS. 1 and 2 of the drawings, an induction furnace 10 comprises a cylindrical or other convenient shaped vessel 12 containing a molten bath 14 of metal and a lower support base 16. Embedded in the support base 16 is a network 18 of flow channels 20 which communicate with the lower end of the bath 14 through openings 22. A circular spiral-wound electro-magnet 24 is also embedded in the base 16. Cooling channels to the electro-magnet 24 may be provided, if desired, to prevent damage to the electro-magnet 24 by heat from the molten metal bath 14.

As may be particularly seen in FIG. 2, the network 18 of flow channels 20 comprises a centrally-located flow channel 26 and six peripherally-located flow channels 28 equally arcuately-spaced from each other and radially spaced from the centrally-located flow channel 26.

The centrally-located flow channel 26 extends axially downwardly with respect to the vessel 12. The peripherally-located flow channels 28 include a downwardly-extending portion which is parallel to the central flow channel 26 and a radially extending portion extending to the lower end of the central channel 26, so that all the peripheral channels 28 communicate with the lower end of the central channel 26.

The spirally-wound electro-magnet 24 is located between the centrally-located channel 26 and the peripherally-located channels 28 with its centre of curvature coinciding with the axis of the centrally-located channel 26. The electro-magnet 24 has a core 30 and spiral windings 32. The spiral windings 32 have electrical connections to three phase current input by wires A—A, B—B and C—C.

While six peripheral channels 28 and three phases of electrical input are illustrated and this relationship is preferred, other numbers may be used provided that the number of peripheral channels is a multiple of two and numbers at least four and that the number of phases of electrical input corresponds to the multiple of two of the peripheral channels.

Figure 3:
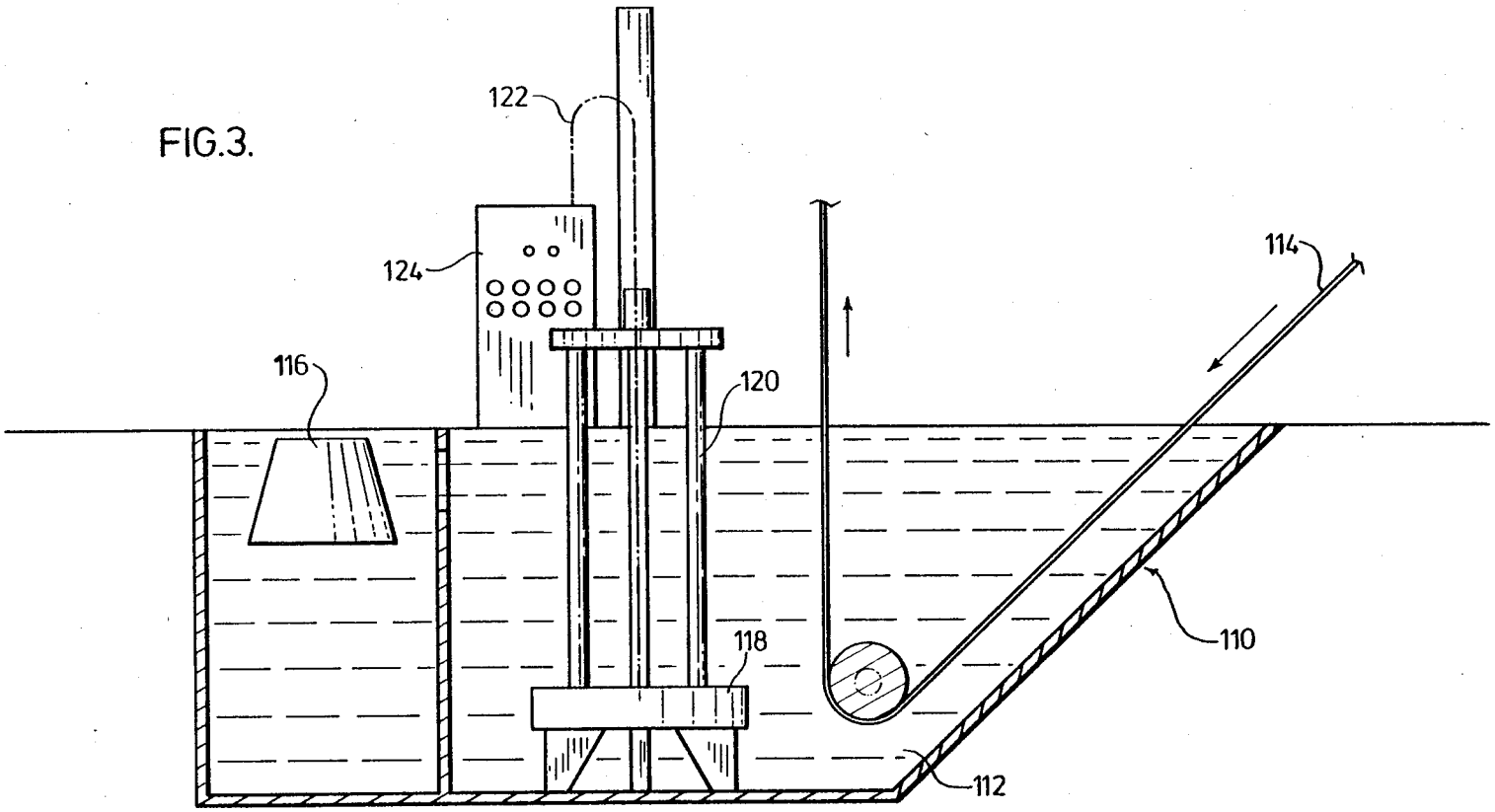
FIG. 3 is a schematic representation of a steel strip galvanizing bath using a second embodiment of the invention.

Referring now to FIG. 3, there is illustrated therein a metal strip galvanizing bath 110 containing a body of molten zinc 112 and through which passes a steel strip 114 for application of a coating of zinc thereto in conventional manner. An ingot 116 of unmelted zinc is immersed in the bath 112 to replenish that removed from the bath 112 on the steel strip 114.

In accordance with the present invention, a circular spiral-wound electro-magnet 118 is immersed in the molten zinc bath 112 to be surrounded by zinc. The electro-magnet 118 is supported by a frame 120 to position the electro-magnet 118 with its axis generally vertical and spaced upwardly from the base of the bath 110. The frame 120 may be hoisted from the bath 112 for servicing of the electro-magnet 118 and may include cooling material feed lines to the electro-magnet 118 to prevent damage thereto by the heat of the bath 112.

The spirally-wound electro-magnet 118 is constructed in analogous manner to electro-magnet 24 and has a core and spiral windings which have electrical connection to three-phase current input, provided by power line 122 from a power supply unit 124.

OPERATION

In operation of the embodiment of FIGS. 1 and 2, under the influence of the multiphase alternating current input, the rotating magnetic field of the electro-magnet 24 induces electric current in the metal in each of the peripheral channels 28 while the three phases cancel each other out in the central channel 26. The metal in the peripheral channels 28 heats up to dissipate the energy resulting from the inability of the peripheral channels to rotate about the central channel while there is negligible heating of the metal in the central channel 26. As a consequence, the metal in the peripheral channels 28 flows upwardly to the body of molten metal 14 in the tank 12 and drawing metal for heating from the body 14 into the central channel 26.

At the same time, the magnetic field of the electro-magnet 24 induces rotational motion of the body of molten metal in the bath 14. This rotary motion tends to decrease the turbulence which otherwise results at the surface of the melt as a result of the upward flow of molten metal peripheral channels 28 into the body of the molten metal 14. By decreasing the turbulence in this manner, decreased oxidation of the metal and entrapment of oxides occurs.

The substantial absence of heating of metal in the central channel 26 enables a considerable flow velocity of circulating heated metal to be attained. Increased mixing results from the rotational motion and the circulation through the channel network 18 enables a decreased alloying time and increased alloy recovery to be achieved. The size of furnace is not inhibited by the limited energy density attainable in the prior art and hence larger installations than has heretofore been possible.

In operation of the embodiment of FIG. 3, the three-phase alternating current electrical input to the electro-magnet 118 produces a rotating magnetic field in the molten zinc body surrounding the electro-magnet 118 and this induces electric current, which in turn produces rotation of the zinc about the axis of the electro-magnet 118. Since the zinc is unable to rotate as quickly as the magnetic field, zinc in the zone peripherally-located with respect to the electro-magnet core 118 heats up while zinc in the middle of the core remains substantially unheated, since the three phases cancel each other out.

This heating of the zinc and the resulting differential in temperature between the heated zinc and the remainder of the bath causes vertical upward movement of the heated zinc into the body of the bath while unheated zinc flows into the centre of the core 118. In this way, heating of the molten bath 112 is achieved while the stirring motion ensures even heating and avoids turbulence in the molten bath 112.

By providing the electro-magnet core 118 on a frame 120 immersed in the molten zinc bath, the core 118 is readily removed from the bath, so that servicing of the unit is readily achieved.

SUMMARY OF DISCLOSURE

In summary of this disclosure, the present invention provides an improved induction furnace by using a single ring core electro-magnet which provides benefits in use. Modifications are possible within the scope of the invention.

What I claim is:

1. A method of induction heating of a body of molten metal in a bath thereof, which comprises:

forming a magnetic field rotating about a generally vertical axis in operative relationship with said body of molten metal, thereby simultaneously electromagnetically inducing:

(1) flow of molten metal which is not electromagnetically heated from the molten metal body and flow of electromagnetically heated molten metal to the molten metal body and (2) rotational motion of the molten metal in the bath about said generally vertical axis.

2. The method of claim 1 wherein said rotating magnetic field is formed by positioning a circular spiral-wound electromagnetic core in operative relationship with said body of molten metal and applying a multiphase alternating current to the spiral winding.

3. A method of induction heating of a body of molten metal in a bath thereof, which comprises:

establishing a network of flow channels in fluid flow communication with said body for flow of molten metal downwardly from said body and upwardly into said body, said network of flow channels comprising a centrally-located substantially vertical flow channel and a plurality of peripherally-located equally-arcuately spaced substantially vertical flow channels in a multiple of two numbering at least four, positioning a circular spiral-wound electromagnetic core between said centrally-located channel and said peripherally-located channels with its centre of rotation coinciding with the axis of the centrally-located channel, and applying a multiphase alternating electrical current to said spiral winding corresponding in number of phases to the multiple of two peripherally-located flow channels, thereby forming a rotating magnetic field which is intersected by metal in said peripherally-located channels causing metal in said peripherally-located channels to be electromagnetically heated to a higher temperature and to flow upwardly into the body of molten metal while metal contained in the centrally-located channel is not so heated and metal from the body flows downwardly into the centrally-located channel, said rotating magnetic field also causing molten metal in said body thereof to rotate about the axis of the centrally located channel.

4. The method of claim 3 wherein there are six peripherally-located flow channels and there is a three-phase electrical current.

5. A method of induction heating of a body of molten metal, which comprises:

immersing a circular spiral-wound electromagnetic core in said body of molten metal to be wholly surrounded by said molten metal and located with its axis substantially vertical, and applying a multiphase alternating current to the spiral winding to form a rotating magnetic field in the body of metal which rotates faster than the viscosity of the metal permits, thereby causing metal peripherally located with respect to the core to rotate and to be heated and to flow upwardly into the body of the metal while metal from said body flows downwardly into the centre of the core and thence into said peripheral location and further simultaneously causing rotational motion of the molten metal in the bath about the axis of core.

6. The method of claim 5 wherein said multiple phase electrical current is three-phase electrical current.

7. In an induction heating apparatus for the melting of metals, comprising a tank for holding a bath of molten metal, a plurality of metal flow channels communicating with the bottom of the bath and electrical field generating heating means operably associated with said plurality of channels to effect heating of metal therein, the improvement which comprises:

providing a centrally-located one of said flow channels and multiples of two peripheral flow channels equally-arcuately spaced from each other and radially-spaced from said centrally-located flow channel, said peripheral flow channels numbering at least four and communicating with said centrally-located flow channel, a circular electro-magnet core positioned below said tank and between said centrally-located flow channel and said peripheral flow channels and having a centre of curvature coinciding with the axis of the centrally-located flow channel, electrical windings on said core adapted to receive multiple phase electrical alternating current power supply in the number of phases corresponding to the multiple of peripheral flow channels, and electrical power means for applying multiple phase alternating current to said electrical windings in said number of phases.

8. The heating apparatus of claim 7 wherein said centrally-located flow channel extends downwardly of the tank to a lower end and said peripheral flow channels include a first portion extending downwardly of the tank from locations adjacent the periphery of the tank parallel to each other and to said centrally-located channel and a second portion extending radially in fluid flow communication with said first portion to communicate with the lower end of said centrally-located flow channel.

9. The heating apparatus of claim 4 wherein there are six of said peripherally-located flow channels and the number of phases of electrical alternating current is three.

* * * * *